US007056580B2

(12) United States Patent
Dugan

(10) Patent No.: US 7,056,580 B2
(45) Date of Patent: Jun. 6, 2006

(54) FIBERS FORMED OF A BIODEGRADABLE POLYMER AND HAVING A LOW FRICTION SURFACE

(75) Inventor: Jeffrey S. Dugan, Erwin, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 0 days.

(21) Appl. No.: 10/815,460

(22) Filed: Apr. 1, 2004

(65) Prior Publication Data

US 2004/0265579 A1 Dec. 30, 2004

Related U.S. Application Data

(60) Provisional application No. 60/461,564, filed on Apr. 9, 2003.

(51) Int. Cl.
*D01F 6/00* (2006.01)

(52) U.S. Cl. ..... 428/372; 428/364

(58) Field of Classification Search ..... 428/364, 428/372

See application file for complete search history.

(56) References Cited

U.S. PATENT DOCUMENTS

| | | | | |
|---|---|---|---|---|
| 5,010,145 | A | 4/1991 | Ikada et al. | |
| 5,057,368 | A | 10/1991 | Largman et al. | |
| 5,069,970 | A | 12/1991 | Largman et al. | |
| 5,108,820 | A | 4/1992 | Kaneko et al. | |
| 5,112,684 | A * | 5/1992 | Halm et al. | 428/357 |
| 5,142,023 | A | 8/1992 | Gruber et al. | |
| 5,165,993 | A * | 11/1992 | van Anholt et al. | 428/364 |
| 5,277,976 | A | 1/1994 | Hogle et al. | |
| 5,336,552 | A | 8/1994 | Strack et al. | |
| 5,344,707 | A * | 9/1994 | Snyder | 428/359 |
| 5,382,400 | A | 1/1995 | Pike et al. | |
| 5,578,368 | A | 11/1996 | Forsten et al. | |
| 5,590,420 | A * | 1/1997 | Gunn | 2/69 |
| 5,593,778 | A | 1/1997 | Kondo et al. | |
| 5,698,322 | A | 12/1997 | Tsai et al. | |
| 5,760,144 | A | 6/1998 | Ozeki et al. | |
| 5,807,973 | A | 9/1998 | Gruber et al. | |
| 6,061,829 | A * | 5/2000 | Gunn | 2/69 |
| 6,261,677 | B1 * | 7/2001 | Tsai et al. | 428/221 |
| 6,340,443 | B1 * | 1/2002 | Kurihara et al. | 264/464 |
| 6,441,267 | B1 * | 8/2002 | Dugan | 604/370 |
| 6,451,914 | B1 * | 9/2002 | Kloos et al. | 525/191 |
| 6,509,092 | B1 * | 1/2003 | Dugan | 428/374 |

FOREIGN PATENT DOCUMENTS

| | | |
|---|---|---|
| JP | 54 124055 A | 9/1979 |
| WO | WO 2004/030880 A1 | 4/2004 |

OTHER PUBLICATIONS

Dugan, Jeffrey S., "Novel Properties of PLA Fibers", *International Nonwovens Journal,* 2001, pp. 29-33, vol. 10, No. 3.

* cited by examiner

*Primary Examiner*—N. Edwards
(74) *Attorney, Agent, or Firm*—Alston & Bird LLP

(57) ABSTRACT

The present invention is directed to fibers formed of a biodegradable polymer and having low friction particles along a surface thereof. The fibers exhibit good lubricity and low flammability and are useful in fiberfill applications.

16 Claims, 2 Drawing Sheets

FIBERS FORMED OF A BIODEGRADABLE POLYMER AND HAVING A LOW FRICTION SURFACE

CROSS REFERENCE TO RELATED APPLICATION(S)

This application is related to commonly owned copending Provisional Application Ser. No. 60/461,564, filed Apr. 9, 2003, incorporated herein by reference in its entirety, and claims the benefit of its earlier filing date under 35 U.S.C. 119(e).

FIELD OF THE INVENTION

The present invention relates to fibers having a biodegradable component, and more particularly to low friction biodegradable fibers and products made therefrom.

BACKGROUND OF THE INVENTION

For many years, down, and down mixed with feathers, were the predominant products for use as filling materials for various consumer goods, such as pillows and sleeping bags. Although durability and resilience are very good (so long as they are not wetted), down and down/feather blends have significant deficiencies. They matt when washed, so dry cleaning is recommended in contrast to home-laundering. The feather quills poke through the ticking and the down passes through the ticking, resulting in loss of pillow height. Many people are allergic to feathers and down. Furthermore, down is very expensive.

To overcome these limitations, crimped synthetic staple fiber, particularly polyester fiberfill, has been used as a filling material for pillows instead of down. The fiberfill is generally made from polyethylene terephthalate (PET) fibers in staple form, of various cut lengths.

Polyester fiberfill filling material has become well accepted as a reasonably inexpensive filling and/or insulating material for filled articles, such as pillows, cushions and other furnishing materials, bedding materials, such as mattress pads, quilts, comforters and duvets, in apparel, such as parkas and other insulated articles of apparel and sleeping bags, because of its bulk filling power, aesthetic qualities and various advantages over other filling materials. Accordingly, polyester fiberfill is now manufactured and used in large quantities commercially.

While polyester fiberfill is useful, there are some disadvantages associated with its use. For example, batts made from such fiberfill materials usually have very little fire resistance. U.S. Pat. No. 5,578,368 to Forsten et al. is directed to the fire resistant material that includes a fiberfill batt and at least one fire resistant layer of aramid fibers. However, aramid fibers are expensive and can reduce the desired aesthetics of the end product.

In addition, polyester fibers can exhibit a relatively high level of fiber-to-fiber friction. To improve the lubricity and aesthetics of polyester fiberfill, it can be desirable to "slicken" the fiberfill with a coating of durable (i.e., wash-resistant) coating. Typically the durable coating is a silicone, i.e., a cured polysiloxane, which provides softness and resiliency to the batt. In addition, a resin binder may be added to stabilize the batt and make it more durable when washed. However, the addition of a slickener or a resin binder increases the flammability of the batt.

BRIEF SUMMARY OF THE INVENTION

The present invention provides unique fiber constructions that exhibit a variety of properties in a single fiber construction. The fibers include at least one biodegradable polymer that forms a portion, and advantageously the entirety, of the outer surface of the fiber. In addition, the fibers of the invention include a plurality of particles formed of a low friction material. The low friction particles are dispersed in the biodegradable polymer and also form a portion of the outer surface of the fibers.

Exemplary biodegradable polymers useful in the invention include polylactic acid (PLA) polymers. PLA offers several advantages, in addition to biodegradability. For example, fibers formed of PLA can exhibit excellence resilience. Such fibers also exhibit inherent low flammability, smoke generation, and heat release. These properties render the fibers of the invention particularly useful for fiberfill applications.

Despite these and other advantages, PLA fibers have not met with widespread use in fiberfill or other applications requiring lubricity or low friction. In this regard, PLA fibers exhibit fiber-to-fiber-friction that is significantly higher than other fiberfill candidates, such as PET. As noted above, typically PET fibers are coated with a liquid silicone agent to increase lubricity. The silicone must be cured (crosslinked) onto the fiber surface for durability. This curing step requires the application of heat. Because the melt temperature of PLA is relatively low (ca. 165° C.), such a heating step cannot be run at conventional temperatures, but rather must be slowed to about half the conventional speed. This in turn results in uncompetitive economics for production of silicone coated PLA fibers. Further, the silicone coating is flammable, thus negatively impacting the inherent low flammability of PLA.

The fibers of the invention overcome the problems associated with the high fiber-to-fiber friction of PLA fibers. The presence of the low friction particles on a portion of the outer surface of the fiber imparts improved lubricity to the fiber. This in turn renders the fibers appropriate for use in fiberfill. In addition, the low friction material itself is not flammable, thus its use does not compromise the low flammability of PLA fibers. Further, because the fibers do not require a coating that must be cured, production speeds are not are not hampered, therefore improving the economies of production of such fibers.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein: Some of the objects and advantages of the invention have been stated. Others will appear when taken in connection with the accompanying drawings, in which:

Figure 4A:
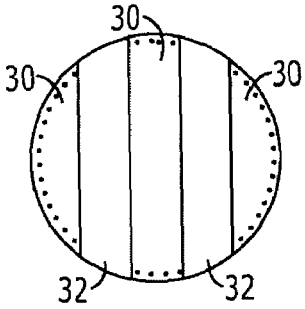
Figure 4B:
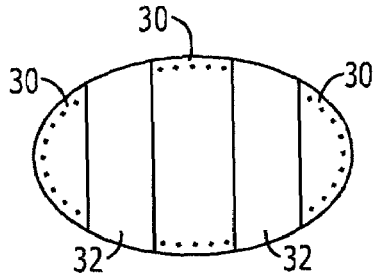
Figure 4C:
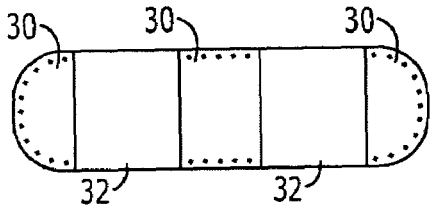
Figure 5A:
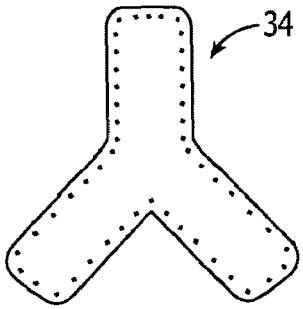
Figure 5B:
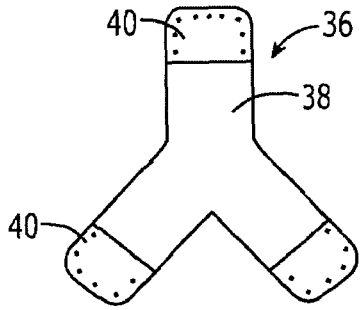

FIGS. 4*a*, 4*b*, and 4*c* are cross sectional views of other exemplary multicomponent fibers of the invention, namely segmented fibers; and FIGS. 5*a* and 5*b* are cross sectional views of other exemplary multicomponent fibers of the invention, namely multilobal fibers.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
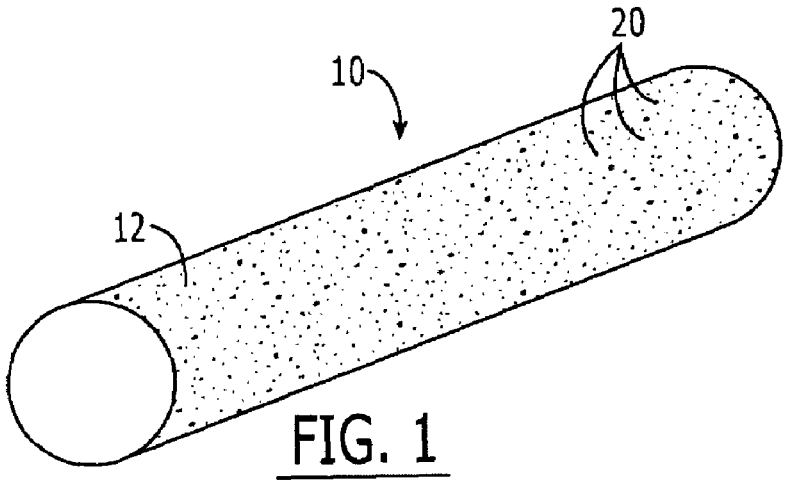
FIG. 1 is a transverse cross sectional view of an exemplary monocomponent fiber of the invention.
Figure 2:
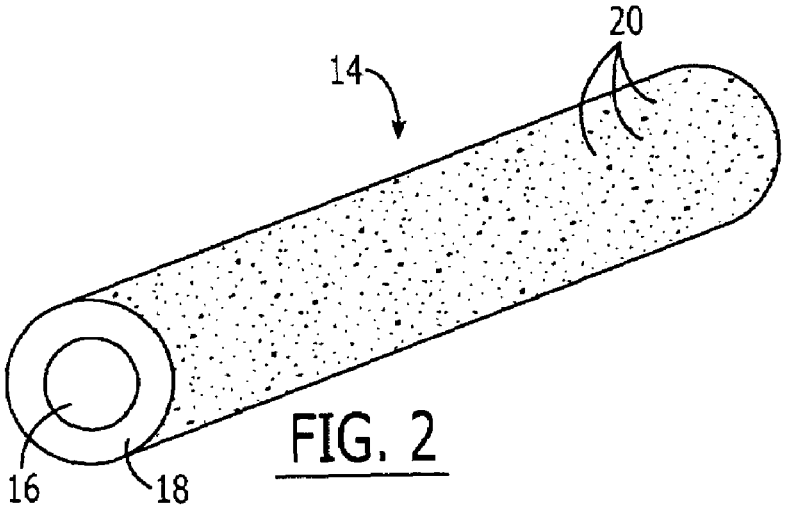
FIG. 2 is a transverse cross sectional view of an exemplary multicomponent fiber of the invention, namely a bicomponent fiber.

FIGS. 1 and 2 are transverse cross sectional views of exemplary fiber configurations useful in the present invention. As illustrated in FIG. 1, the fiber can be a monocomponent fiber 10 having a single polymer component 12. The single polymer component in this embodiment is formed of a biodegradable polymer, as discussed in more detail below.

Alternatively, the fiber can be a multicomponent fiber. FIG. 2 illustrates an exemplary multicomponent fiber construction useful in the present invention, namely, a bicomponent fiber 14 having an inner core polymer domain 16 and surrounding sheath polymer domain 18. The sheath component is formed of a biodegradable polymer.

Whether the fiber is a monocomponent fiber or multicomponent fiber, the fibers also includes a plurality of particles formed of a low friction material, indicated as 20 in both FIGS. 1 and 2. The low friction particles are present along a portion of the outer surface of the fiber. In this manner the low friction particles can impart a desired level of lubricity to the fibers so as to render the fibers useful in various applications requiring low fiber-to-fiber friction.

As used herein, the term "multicomponent fibers" includes staple and continuous filaments prepared from two or more polymers present in discrete structured domains in the fiber, as opposed to blends where the domains tend to be dispersed, random or unstructured. The two or more structured polymeric components are arranged in substantially constantly positioned distinct zones across the cross section of the multicomponent fiber and extending continuously along the length of the multicomponent fiber.

For purposes of illustration only, the present invention will generally be described in terms of a bicomponent fiber comprising two components. However, it should be understood that the scope of the present invention is meant to include fibers with two or more structured components.

Sheath/core fibers include a first sheath component that surrounds a second core component. The sheath can be continuous, e.g., completely surround the core and form the entire outer surface of the fiber. Alternatively the sheath may be non-contiguous, e.g., form less than the entire outer surface of the fiber.

Figure 3:
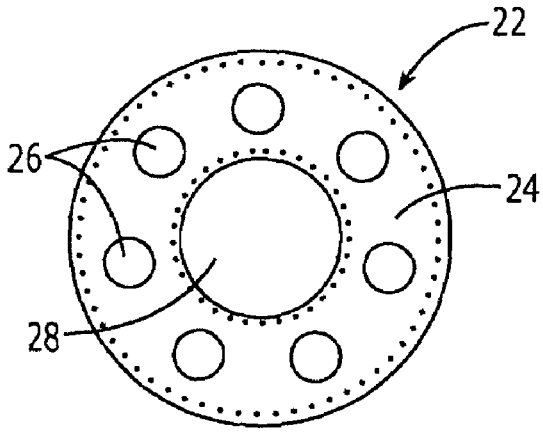
FIG. 3 is a cross sectional view of another exemplary multicomponent fiber of the invention, namely an island-in-the-sea fiber.

Other structured fiber configurations as known in the art can also be used, so long as the biodegradable polymer forms at least a portion of the outer surface of the fiber, and further that a plurality of low friction particles also are present along at least a portion of the outer surface of the fiber. As an example, another suitable multicomponent fiber construction includes "islands-in-the-sea" arrangements. FIG. 3 illustrates a cross sectional view of one such fiber 22, which includes an outer "sea" component 24 formed of a biodegradable polymer and having low friction particles along an outer surface thereof and a plurality of island components 26. The island components can be formed of a biodegradable or non-biodegradable polymer. The islands-in-the-sea fiber can optionally also include a core 28, which also can be formed of a biodegradable or non-biodegradable polymer.

FIGS. 4*a–c* are cross sectional views of additional fibers constructions, namely segmented fibers, such as a segmented round fibers (FIG. 4*a*), segmented oval fibers (FIG. 4*b*), and segmented rectangular fibers (FIG. 4*c*). As illustrated, the segmented fibers include biodegradable polymer segments or components 30 having low friction particles present therein alternating with polymer segments or components 32. Segments 32 can be formed of a biodegradable or non-biodegradable polymer. Although not illustrated, segments 32 can also include low friction particles present therein.

Figure 5C:
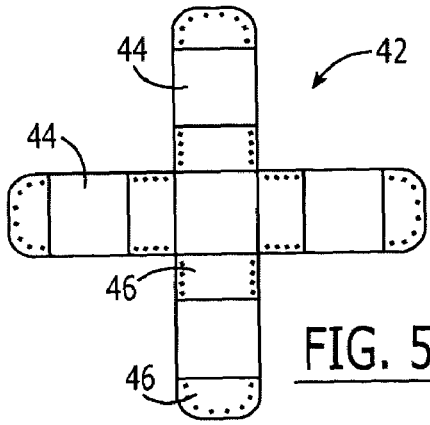

Still further the fibers can be multilobal fibers having three or more arms or lobes extending outwardly from a central portion thereof. FIGS. 5*a*–5*b* are cross sectional views of exemplary multilobal fibers of the invention. The multilobal fibers can be formed entirely of the biodegradable polymer with low friction particles dispersed therein so the particles form a portion of the outer surface of the fiber, such as fiber 34 in FIG. 5*a*. Alternatively the multilobal fibers can include other polymeric components, such as fiber 36 of FIG. 5*b*, which includes a central core 38 and arms or lobes 40 extending outwardly therefrom. The arms or lobes 40 are formed of a biodegradable polymer with low friction particles present therein. Central core 38 can be formed of a biodegradable or non-biodegradable polymer and optionally can also include low friction particles. Another exemplary multilobal figure is shown in FIG. 5*c*, designated as 42, having arms of alternating segments or components 44 and 46. Segments 46 are formed of a biodegradable polymer with low friction particles present therein. Segments 44 can be formed of a biodegradable or non-biodegradable polymer, and also can optionally include low friction particles as well.

Any of these or other multicomponent fiber constructions may be used, so long as at least a portion of the outer surface of the fiber includes the biodegradable polymer and further so long as a plurality of low friction particles are present on the outer surface of the fiber as well. Reference is made to U.S. Pat. No. 5,108,820 to Kaneko et al., U.S. Pat. No. 5,336,552 to Strack et al., U.S. Pat. No. 5,382,400 to Pike et al., U.S. Pat. No. 5,277,976 to Hogle et al., and U.S. Pat. Nos. 5,057,368 and 5,069,970 to Largman et al.

The cross section of the fiber is preferably circular, since the equipment typically used in the production of synthetic fibers normally produces fibers with a substantially circular cross section. In bicomponent fibers having a circular cross section, the configuration of the first and second components can be either concentric or acentric, the latter configuration sometimes being known as a "modified side-by-side" or an "eccentric" multicomponent fiber.

The fibers of the invention include at least one biodegradable polymer as known in the art. As used herein, "biodegradable" refers to a material that degrades under aerobic and/or anaerobic conditions in the presence of bacteria, fungi, algae, and other microorganisms to carbon dioxide/methane, water and biomass, although materials containing heteroatoms can also yield other products such as ammonia or sulfur dioxide. "Biomass" generally refers to the portion of the metabolized materials incorporated into the cellular structure of the organisms present or converted to humus fractions indistinguishable from material of biological origin. As a result, the biodegradable fiber, either in its initial form or after incorporation into a fabric, will begin to degrade when exposed to such microorganisms, even if such exposure occurs prior to the expiration of the useful life of the fiber.

Exemplary biodegradable polymers include, without limitation, polyvinyl alcohol, hydrolyzable aliphatic polyesters, hydrolyzable aliphatic polyurethanes, cis-polyisoprene, cis-polybutadiene, polycaprolactone, hydrolyzable polylactic acid, polyhydroxy alkanoates, and the like and copolymers and blends thereof. The skilled artisan will appreciate that when polylactic acid is used, the polylactic acid polymer is first hydrolyzed before microorganisms can consume the hydrolysis products.

Advantageously the biodegradable polymeric component comprises polylactic acid (PLA). In addition to biodegradability, polylactic acid can impart other desirable properties to the fibers of the invention. PLA polymer fibers are particularly useful in fiberfill applications because of their resilience, inherent low flammability, and renewability.

To provide the benefits of the PLA polymer characteristics to the fibers formed thereof, at least a portion of the outer surface of the fibers comprises the biodegradable, e.g., PLA, polymer. In a preferred embodiment of the invention, the entire outer surface of the fiber comprises PLA polymer.

Polylactic acid polymer is a biodegradable polyester polymer generally prepared by the polymerization of lactic acid. However, it will be recognized by one skilled in the art that a chemically equivalent material may also be prepared by the polymerization of lactide. Therefore, as used herein, the term "polylactic acid polymer" is intended to represent the polymer that is prepared by either the polymerization of lactic acid or lactide. Reference is made to U.S. Pat. Nos. 5,698,322; 5,142,023; 5,760,144; 5,593,778; 5,807,973; and 5,010,145, the entire disclosure of each of which is hereby incorporated by reference.

Lactic acid and lactide are known to be an asymmetrical molecules, having two optical isomers referred to, respectively as the levorotatory (hereinafter referred to as "L") enantiomer and the dextrorotatory (hereinafter referred to as "D") enantiomer. As a result, by polymerizing a particular enantiomer or by using a mixture of the two enantiomers, it is possible to prepare polymers that are chemically similar yet which have widely differing properties. In particular, it has been found that by modifying the stereochemistry of a polylactic acid polymer, it is possible to control the melting temperature of the polymer.

The fibers of the invention can also include non-biodegradable polymers, for example, to form a core component of a sheath/core fiber, the island components of an islands-in-the-sea fiber, and the like. Non-biodegradable polymers suitable for use in the fibers of the invention include without limitation polyolefins, polystyrenes, polyurethanes, acetal resins, polyethylene vinyl alcohol, and copolymers, terpolymers, and mixtures thereof. Olefinic resins, long-chain, synthetic polymers of at least 85 weight percent ethylene, propylene or other olefin unit, are of particular interest. Suitable polyolefins include polypropylene, low density polyethylene, high density polyethylene, linear low density polyethylene, polybutene, and copolymers, terpolymers and mixtures thereof. In addition, the non-biodegradable polymeric component may include mixtures of polyolefins with other polymers, such as but not limited to (ethyl vinyl acetate) copolymers, (ethylene acrylic acid) copolymers, and the like.

Each of the biodegradable and non-biodegradable polymers can optionally include other components not adversely affecting the desired properties thereof. Exemplary materials that could be used as additional components would include, without limitation, pigments, antioxidants, stabilizers, surfactants, waxes, flow promoters, solid solvents, particulates, and other materials added to enhance processability of the first and the second components. For example, a stabilizing agent may be added to the biodegradable polymer to reduce thermal degradation which might otherwise occur during the polylactic acid spinning process. Further, additives that enhance the biodegradability of the polylactic acid may optionally be included. These and other additives can be used in conventional amounts.

The particles 20 are formed of a material capable of imparting low friction properties to a product produced having the same dispersed therein. In addition, the low friction material is selected to have minimal or no flammability. Further the low friction material is selected to be non-melting or have a melting point that is sufficiently above the melting point of the polymers used to produce the fibers so that the particles do not melt during production of the fibers.

Advantageously the low friction material is a fluoropolymer, and more preferably a non-melt processable fluoropolymer as known in the art. Non-melt processable fluoropolymers typically have high melting points as compared to fluoropolymers prepared for extrusion applications. However, thermoplastic fluoropolymers developed for extrusion processes generally can also be useful in the present invention, so long as the fluoropolymer has a sufficiently high melting point so that the particles do not melt during fiber production.

Particularly useful fluoropolymers include non-melt processable polytetrafluoroethylene (PTFE) homopolymer. Copolymers of PTFE can also be used. Exemplary comonomers include all of the olefins capable of copolymerizing with tetrafluoroethylene, including without limitation, hexafluoropropylene, perfluorooxyalkyl vinyl ethers having C1–C4 alkyl radicals, vinylidene fluoride, ethylene and/or propylene, vinyl esters and acrylic monomers. The amount of comonomer when present can vary, so long as the amount does not effect the properties necessary for use in the production of fibers, for example, does not lower the melt temperature significantly so that the particles melt during fiber extrusion, change the particle morphology to preclude significant migration thereof to the fiber surface during extrusion, and the like.

The low friction particles are present in the biodegradable polymer component forming a surface of the fiber in an amount sufficient to provide the desired degree of fiber-to-fiber friction for a particular application. The fibers can include up to 15 percent by weight of the low friction particles. However, the invention is effective at much lower concentrations of the low friction particles, even at levels of about 4 percent by weight, or less, for example as little as 0.1 percent by weight, based on the total weight of the fiber.

The low friction particles can be blended with the polymer in dry form, i.e., by dry blending solid state forms of the low friction particles and polymer in powder form. The dry blend can then be used in a fiber extrusion process under conditions sufficient to form a polymer melt without also melting the low friction particles and to extrude the polymer melt to form fibers with the low friction particles along a surface thereof. Alternatively the low friction particles, in the form of a powder or non-aqueous dispersion, can be added to an extruder and blended with the polymer melt, again at temperatures sufficient to form a polymer melt without also melting the low friction particles. Still further, the low friction particles may be added to the polymer directly or in the form of a concentrate (or masterbatch).

The low friction particles advantageously have an average particle size that is small enough to allow fiber extrusion without significant clogging of the spinneret or upstream polymer filters. Yet the particles are also of sufficient size so as to impart the desired level of lubricity to the resultant fibers. Useful low friction particles include particles having an average diameter ranging from about less than one (submicron particles) to about 10 microns, and include PTFE micropowders prepared by radiation (gamma or electron beam) degradation. Low friction particles, including PTFE particles, are known in the art and include those available from Shamrock Technologies, Inc. under the trade name NanoFLON™ and Fluoro™ PTFE.

The fibers can include varying percentages of the biodegradable polymer component with low friction particles present therein. For example, the fiber can include from as little as 8 percent by weight, based on the total fiber weight, up to 100 percent of the biodegradable polymer with low friction particles. Advantageously, for a sheath/core construction, the fiber includes a weight ratio of sheath to core ranging from about 10:90 to 90:10, more advantageously from about 30:70 to about 70:30, and most advantageously from about 25:75 to about 70:25. Fibers in which the sheath:core ratio is about 25:75 to about 30.70 can be particularly useful when the core includes the same polymer as the sheath.

Methods for making multicomponent fibers are well known and need not be described here in detail. Generally, to form a multicomponent fiber, at least two polymers are extruded separately and fed into a polymer distribution system wherein the polymers are introduced into a spinneret plate. The polymers follow separate paths to the fiber spinneret and are combined in a spinneret hole. The spinneret is configured so that the extrudant has the desired shape.

Following extrusion through the die, the resulting thin fluid strands, or filaments, remain in the molten state for some distance before they are solidified by cooling in a surrounding fluid medium, which may be chilled air blown through the strands. Once solidified, the filaments are taken up on a godet or another take-up surface. In a continuous filament process, the strands are taken up on a godet which draws down the thin fluid streams in proportion to the speed of the take-up godet. In the jet process, the strands are collected in a jet, such as for example, an air gun, and blown onto a take-up surface such as a roller or a moving belt to form a spunbond web. In the meltblown process, air is ejected at the surface of the spinnerette which serves to simultaneously draw down and cool the thin fluid streams as they are deposited on a take-up surface in the path of cooling air, thereby forming a fiber web. Regardless of the type of melt spinning procedure which is used, it is important that the thin fluid streams be melt drawn down in a molten state, i.e. before solidification occurs to orient the polymer molecules for good tenacity. Typical melt draw down ratios known in the art may be utilized. Where a continuous filament or staple process is employed, it may be desirable to draw the strands in the solid state with conventional drawing equipment, such as, for example, sequential godets operating at differential speeds.

Following drawing in the solid state, the continuous filaments may be crimped or texturized and cut into a desirable fiber length, thereby producing staple fiber. The length of the staple fibers generally ranges from about 25 to about 50 millimeters, although the fibers can be longer or shorter as desired.

The fibers of the invention can be staple fibers, continuous filaments, or meltblown fibers. In general, staple, multifilament, and spunbond fibers formed in accordance with the present invention can have a fineness of about 0.5 to about 100 denier. Meltblown filaments can have a fineness of about 0.001 to about 10.0 denier. Monofilament fibers can have a fineness of about 50 to about 10,000 denier.

The fibers of the invention are useful in the production of a wide variety of products, including without limitation nonwoven structures, such as but not limited to carded webs, wet laid webs, dry laid webs, spunbonded webs, meltblown webs, and the like. The fibers of the invention can also be used to make other textile structures such as but not limited to woven and knit fabrics. Fibers other than the fibers of the invention may be present in articles produced therefrom, including any of the various synthetic and/or natural fibers known in the art. Exemplary synthetic fibers include polyolefin, polyester, polyamide, acrylic, rayon, cellulose acetate, thermoplastic multicomponent fibers (such as conventional sheath/core fibers, for example polyethylene sheath/polyester core fibers) and the like and mixtures thereof. Exemplary natural fibers include wool, cotton, wood pulp fibers and the like and mixtures thereof.

In one particularly advantageous aspect of the invention, the fibers are used as a filling material, also referred to in the art as fiberfill. The fibers may be processed using known techniques to make a fiberfill, typically to produce a batting which may be bonded or non-bonded. The fibers of the invention may make up 100% of the fiberfill. Alternatively other types of fibers such as noted above can be included as a part of the batting when desired. Generally the fiberfill includes at least about 50 percent up to 100 percent by weight of the fibers of the invention.

The invention also provides filled articles wherein at least some of the filling material is in the form of batting of the fibers of the invention. For example, the invention includes articles such as a pillow filled with filling material that includes the fibers formed of a biodegradable polymer and low friction particles. Other filled articles in accordance with the invention include, without limitation, articles of apparel, such as parkas and other insulated or insulating articles of apparel, bedding materials (sometimes referred to as sleep products) other than pillows, including mattress pads, comforters and quilts including duvets, mattress tops, and sleeping bags and other filled articles suitable for camping purposes, for example, furnishing articles, such as cushions, "throw pillows" (which are not necessarily intended for use as bedding materials), and filled furniture itself, toys and, indeed, any articles that can be filled with polyester fiberfill.

The present invention will be further illustrated by the following non-limiting examples.

Example 1: A hollow fiber was made from PLA, cut, crimped, and a conventional fiber finish applied. The fiber was judged to be not nearly slick enough for use in fiberfill applications.

Example 2: A hollow fiber was made from PLA, crimped, cut, and a non-silicone "slickening" finish applied. The fiber was judged to be not slick enough for use in fiberfill applications.

Example 3: A hollow fiber was made from PLA, crimped, cut, and a second non-silicone "slickening" finish applied. The fiber was judged to be not slick enough for use in fiberfill applications.

Example 4: A hollow fiber was made from PLA, crimped, cut, and a silicone finish applied. To cure the silicone finish without reaching temperatures that would adversely affect the PLA fiber properties, the heat-treatment step following finish application had to be run at one half the speed of the process used in Examples 1, 2, 3, 5, and 6. This fiber was judged suitably slick for use in fiberfill applications.

Example 5: A sheath/core fiber with a diameter equal to those in examples 1–4 was made with a core of PLA incorporating no PTFE additive and a sheath with 4% submicron PTFE particles. The sheath comprised 35% of the fiber by volume, while the core comprised 65%. The fiber was crimped, cut, and the non-silicone "slickening" finish used in Example 2 applied. The fiber was judged slick enough for use in fiberfill applications.

Example 6: A sheath/core fiber with a diameter equal to those in examples 1–4 was made with a core of PLA incorporating no PTFE additive and a sheath with 4% submicron PTFE particles. The sheath comprised 35% of the fiber by volume, while the core comprised 65%. The fiber was crimped, cut, and the non-silicone "slickening" finish used in Example 3 applied. The fiber was judged slick enough for use in fiberfill applications, and even slicker than the fibers in any of the other examples, including that of Example 4.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A fiber having an exposed surface, comprising: a biodegradable synthetic polymer forming a portion of the exposed surface of the fiber; and a plurality of particles formed of a low friction material also forming a portion of the exposed surface of the fiber, wherein said biodegradable synthetic polymer is selected from the group consisting of polyvinyl alcohol, aliphatic polyurethanes, cis-polyisoprene, cis-polybutadiene, polycaprolactone, polylactic acid, polyhydroxy alkanoates, and copolymers and blends thereof.

2. The fiber of claim 1, wherein said fiber is a monocomponent fiber.

3. The fiber of claim 1, wherein said low friction particles are formed of a fluoropolymer.

4. The fiber of claim 3, wherein said low friction particles are formed of a non-thermoplastic fluoropolymer.

5. The fiber of claim 4, wherein said fluoropolymer is selected from non-melt processable polytetrafluoroethylene (PTFE) homopolymers and copolymers thereof.

6. The fiber of claim 5, wherein said copolymer includes one or more monomers selected hexafluoropropylene, perfluorooxyalkyl vinyl ethers having C1–C4 alkyl radicals, vinylidene fluoride, ethylene, propylene, vinyl esters and acrylic monomers.

7. The fiber of claim 1, wherein said low friction particles are present in said fiber in an amount ranging from about 0.1 to about 15 percent by weight based on the total weight of the fiber.

8. A fiberfill material comprising fibers having an exposed surface and comprising: a biodegradable synthetic polymer forming at least a portion of the exposed surface of the fiber; and a plurality of particles formed of a low friction material also forming at least a portion of the exposed surface of the fiber, wherein said biodegradable synthetic polymer is selected from the group consisting of polyvinyl alcohol, aliphatic polyurethanes, cis-polyisoprene, cis-polybutadiene, polycaprolactone, polylactic acid, polyhydroxy alkanoates, and copolymers and blends thereof.

9. The fiber of claim 1, wherein said biodegradable synthetic polymer is polylactic acid.

10. The fiber of claim 1, wherein said low friction particles are present in said fiber in an amount ranging from about 0.1 to about 4 percent by weight based on the total weight of the fiber.

11. The fiber of claim 1, wherein said low friction particles have an average diameter of less than about 5 microns.

12. The fiber of claim 1, wherein said low friction particles have an average diameter of less than about 1 micron.

13. The fiber of claim 1, wherein said fiber is selected from the group consisting of staple fibers, continuous filaments, meltblown fibers, and spunbond fibers.

14. The fiberfill material of claim 8, wherein said low friction particles are formed of a non-thermoplastic fluoropolymer.

15. The fiberfill material of claim 8, wherein said biodegradable synthetic polymer is polylactic acid.

16. The fiberfill material of claim 8, wherein said low friction particles have an average diameter of less than about 1 micron.

* * * * *

UNITED STATES PATENT AND TRADEMARK OFFICE

CERTIFICATE OF CORRECTION

PATENT NO. : 7,056,580 B2
APPLICATION NO. : 10/815460
DATED : June 6, 2006
INVENTOR(S) : Dugan It is certified that error appears in the above-identified patent and that said Letters Patent is hereby corrected as shown below:

Column 7,
Line 27, "30.70" should read --30:70--.

Column 10,
Lines 32 and 33, "5 microns" should read --10 microns--.

Signed and Sealed this

Twelfth Day of December, 2006

JON W. DUDAS
*Director of the United States Patent and Trademark Office*